United States Patent [19]

Emery

[11] 4,000,827

[45] Jan. 4, 1977

[54] PRODUCE CONTAINER

[76] Inventor: Anthony Emery, 448 Scenic Ave., San Anselmo, Calif. 94960

[22] Filed: Jan. 9, 1976

[21] Appl. No.: 647,897

[52] U.S. Cl. ..... 220/4 F; 220/76; 220/1.5; 217/13; 217/43 A

[51] Int. Cl.[2] ..... B65D 7/00; B65D 9/12; B65J 1/02

[58] Field of Search ..... 220/4 R, 4 F, 1.5, 75, 220/76; 217/13, 43

[56] References Cited

UNITED STATES PATENTS

| | | | |
|---|---|---|---|
| 3,410,441 | 11/1968 | Rhyne | 220/4 F |
| 3,591,212 | 7/1971 | Rhyne | 220/76 X |
| 3,853,238 | 12/1974 | Luisada et al. | 220/4 F X |

*Primary Examiner*—William Price
*Assistant Examiner*—Steven M. Pollard
*Attorney, Agent, or Firm*—Flehr, Hohbach, Test, Albritton & Herbert

[57] ABSTRACT

A lightweight container formed of a plastics material is provided for use in carrying fresh produce. The container base and side panels are molded with interfitting tenon and mortise joints which provide a strong and tight fit but yet which permit easy knock-down for storage or return of the container parts. Ledges formed on the lower margins of the side panels interfit with sockets formed along the base. The corners and side margins of the base are captured within horizontal slots in the corner and intermediate tenons of the panel, while locking ribs formed above these tenons fit into vertical slots in the base. A plurality of slots are provided in the inner region of the base for drainage and air circulation. Openings are formed beneath the base for insertion of the tines of a forklift truck.

13 Claims, 7 Drawing Figures

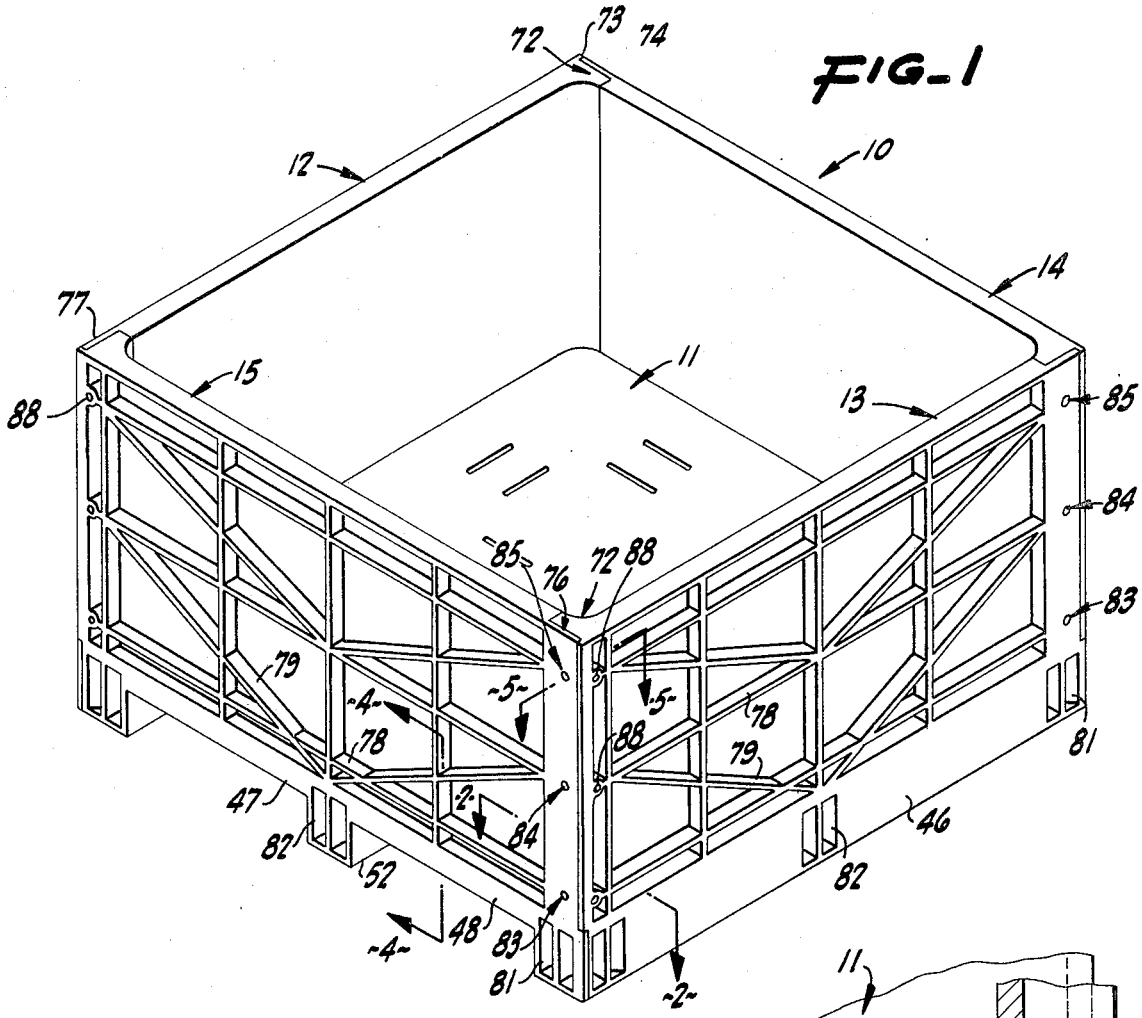
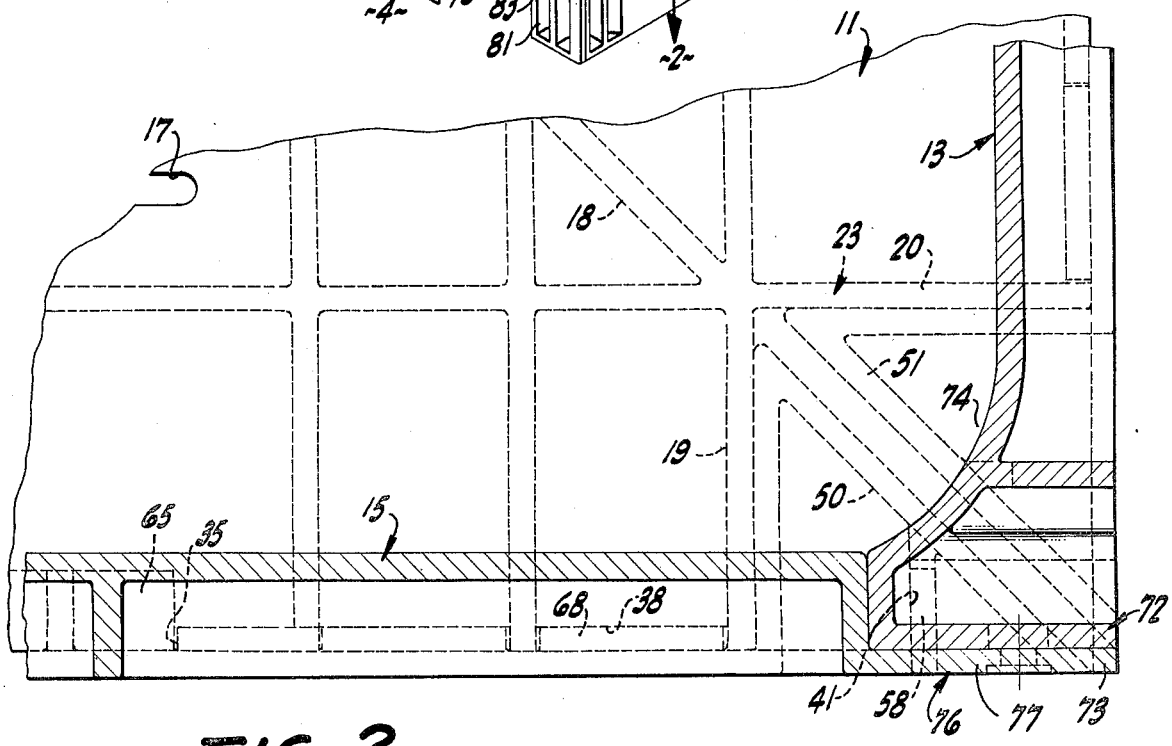
FIG-2

PRODUCE CONTAINER

BACKGROUND OF THE INVENTION

This invention relates to containers for use in transporting fresh produce such as tomatoes, peaches, grapes, oranges or melons and the like.

Containers for transporting fresh produce from the field to a processing plant or storage facility via trailers or trucks conventionally have rectangular side walls and a floor forming an enclosure of a size on the order of four or more feet in lateral dimensions and two or more feet deep. Heretofore these produce containers have been of wood construction. Being of wood the containers have been of wood construction. Being of wood the containers are relatively heavy and cumbersome to handle. The containers are not adapted to be knocked-down following shipment of the produce and therefore occupy valuable space during storage or return shipment when empty. The wooden walls and floors of the containers are also relatively absorbent to water and other liquids so that contamination of the produce from contact with the wood is a problem. Moreover, splinters from the wood surfaces can also contaminate the produce. Conventional wooden containers are also relatively expensive from the standpoint of both material and construction costs. Accordingly, the need has been recognized for a produce container which will obviate the problems and limitations of conventional containers.

OBJECTS AND SUMMARY OF THE INVENTION

It is a general object of the invention to provide a new and improved container for use in transporting fresh produce.

Another object is to provide a produce container which is relatively simple to assemble and handle and which is also of lightweight inexpensive construction.

Another object is to provide a produce container which can be easily assembled from separate base and side panels to form a strong fit but which can be readily knocked-down following use for storage or return of the container parts.

Another object is to provide a produce container having separate base and side panels which are molded of a durable, relatively non-absorbent plastics material such that produce contamination is avoided.

The invention in summary includes a container comprised of a planar base and four side panels molded of a lightweight plastics material. The lower corners of each panel are formed with beveled partial tenons cooperating together to define corner tenons which interengage corner mortises formed in the base. Intermediate tenons formed along the lower edges of the panels engage mortises provided between the corners of the base. Elongate ledges in the panels seat into sockets formed along the sides of the base, and locking ribs formed above the tenons engage vertical slots in the edges of the base. Vertical tenons formed in one side of each panel engage vertical mortises formed in a side of an adjacent panel, and quick-release fastener means are provided to secure the panels together to hold the container parts as a rigid unit. Fluid drain and air circulation slots are formed in the base and openings are provided below the base to permit insertion of the tines of a forklift truck.

The foregoing and additional objects and features of the invention will become apparent from the following description in which the preferred embodiments have been set forth in detail in conjunction with the accompanying drawings.

BRIEF DESCRIPTION OF THE DRAWINGS

FIG. 1 is a perspective view of a produce container made in accordance with the invention.

FIG. 2 is a partial cross-sectional view taken along the line 2—2 of FIG. 1.

FIG. 3 is a fragmentary perspective exploded view illustrating the relationship of the base with one side panel of the invention.

DESCRIPTION OF THE PREFERRED EMBODIMENTS

Figure 4:
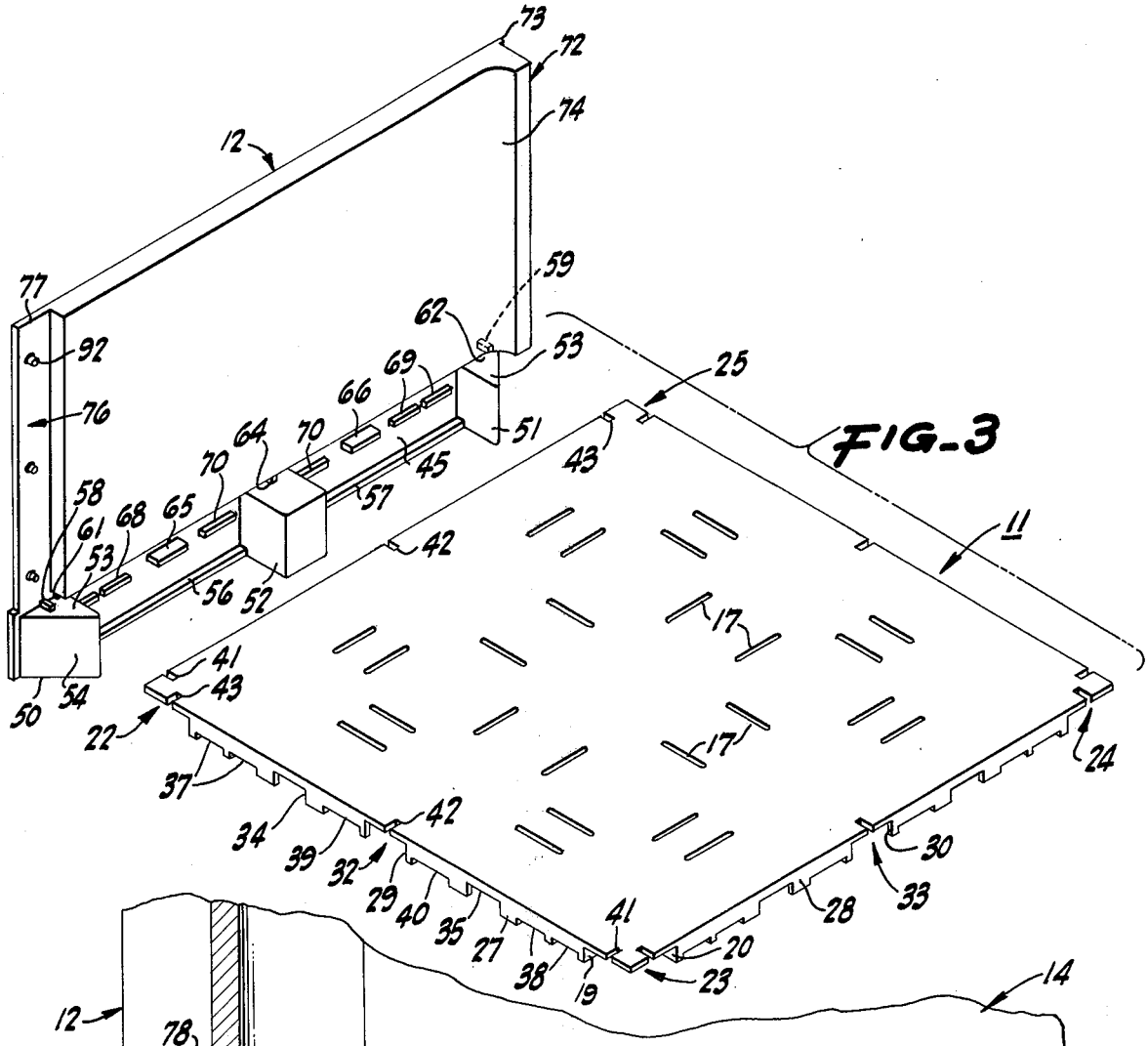
FIG. 4 is a partial sectional view taken along line 4—4 of FIG. 1.

In the drawings FIG. 1 illustrates generally at 10 a produce container of the invention adapted for transporting fresh produce such as tomatoes, peaches, grapes, oranges or melons and the like. Container 10 is comprised of a rectangular planar base 11 and four rectangular planar side panels 12–15 mounted about the periphery of the base to define an upwardly open enclosure having external dimensions, as an example, of 46½ inches in length and breadth and 28 inches in depth. The base and side panels are formed of a suitable liquid impervious, lightweight, durable plastics material which facilitates fabrication of the base and panels by low cost injection molding techniques. A preferred plastics material which is suitable for this purpose is structural foam polypropylene co-polymer.

As best shown in FIG. 3 base 11 is molded with a flat upper surface which forms the floor of the enclosure. A plurality of slots 17 are formed in pairs in the central region of the base for drainage and to permit air to circulate into and out of the enclosure and thereby inhibit produce degradation. A reticulated matrix of ribs 18–20 (FIG. 2) is molded integrally on the bottom of the base to provide lightweight structural load support. At each corner of the base pairs of the ribs 19 and 20 form the side walls of square-shaped, downwardly open corner mortises 22–25, as illustrated in FIG. 2 for the typical corner mortise 23. Integral walls 27, 28 extend along the sides of the base between the ribs of each corner mortise. Openings 29, 30 formed at the mid-span of the walls 27 and 28 are in register with sections of the rib matrix which define square-shaped, downwardly open intermediate mortises 32, 33. Each wall 27, 28 is also molded with a pair of vertically deep cutouts or sockets 34, 35. At the portion of the walls between the corner mortises and deep sockets pairs of downwardly open shallow cutouts or sockets 37, 38 are formed, and at the wall portion between the intermediate mortise and deep sockets additional shallow cutouts or sockets 39, 40 are formed. Along each side of the base vertical slots 41, 42, 43 are formed at the corner and intermediate mortises with these slots extending in directions perpendicular to the edges.

The side panels 12, 13 of the container are identical in shape but are oppositely disposed and each such panel is molded with a lower skirt 45, 46 which contacts the ground or other supporting surface. The other pair of panels 14, 15 are molded at their lower ends with a pair of openings 47, 48 to permit air to circulate below the base and into the slots 17, and also to permit insertion of the tines of a forklift truck for lifting the container.

Prism-shaped partial tenons 50, 51 are molded at the opposite lower corners of each of the four panels, and a cube-shaped intermediate tenon 52 is molded at the lower mid-span between each corner tenon. Each partial tenon is formed with top and bottom triangularly shaped ends 53 together with a flat beveled face 54 disposed at an angle of substantially 45° with the panel and extending inwardly of the enclosure. The dimensions of the perpendicular sides of the ends 53 are commensurate with the dimensions of adjacent sides of the corner mortises 22–25 so that each of these tenons occupy substantially one-half of the space of a corner mortise. Similarly, the dimensions of the intermediate tenons 52 are commensurate with the dimensions of the intermediate mortises 22, 23 so that these tenons can snugly fit into the respective mortises. A pair of reinforcing ribs 56, 57 are molded along the lower edge of each panel 12 and 13 between the partial and intermediate tenons.

Locking ribs 58, 59 are molded on the top ends 53 of the partial tenons and project perpendicular to the panel, and these ribs are sized for engagement with corresponding vertical slots 41 and 43 formed in the corners of the base. The overhanging portion of the panel is spaced above the surfaces of the partial tenons so that horizontal slots 61, 62 are formed of a height commensurate with the thickness of the base corner, which seats into these slots. A similar slot 63, FIG. 4, is formed above intermediate tenon 52 for seating the edge of the base. An additional locking rib 64 is molded between the upper surface of the intermediate tenon so as to interfit with the intermediate slot 42 of the base.

A pair of horizontally elongate upper ledges 65, 66 are formed on the inner side of each panel between the intermediate tenon and the respective partial tenon. A triangular support bracing rib 67 is molded below each ledge integral with the skirt 45. Each upper ledge is sized for seating into a respective socket 35 of the base as shown in FIG. 4. Pairs of horizontally elongate lower ledges 68, 69 are molded between each upper ledge and a respective partial tenon, while an additional horizontally elongate lower ledge 70 is molded between each upper ledge and the intermediate tenon. Each of the lower ledges are sized for seating into a respective socket 37–40 of the base. The upper and lower ledges provide support for the periphery of the base.

Figure 5:
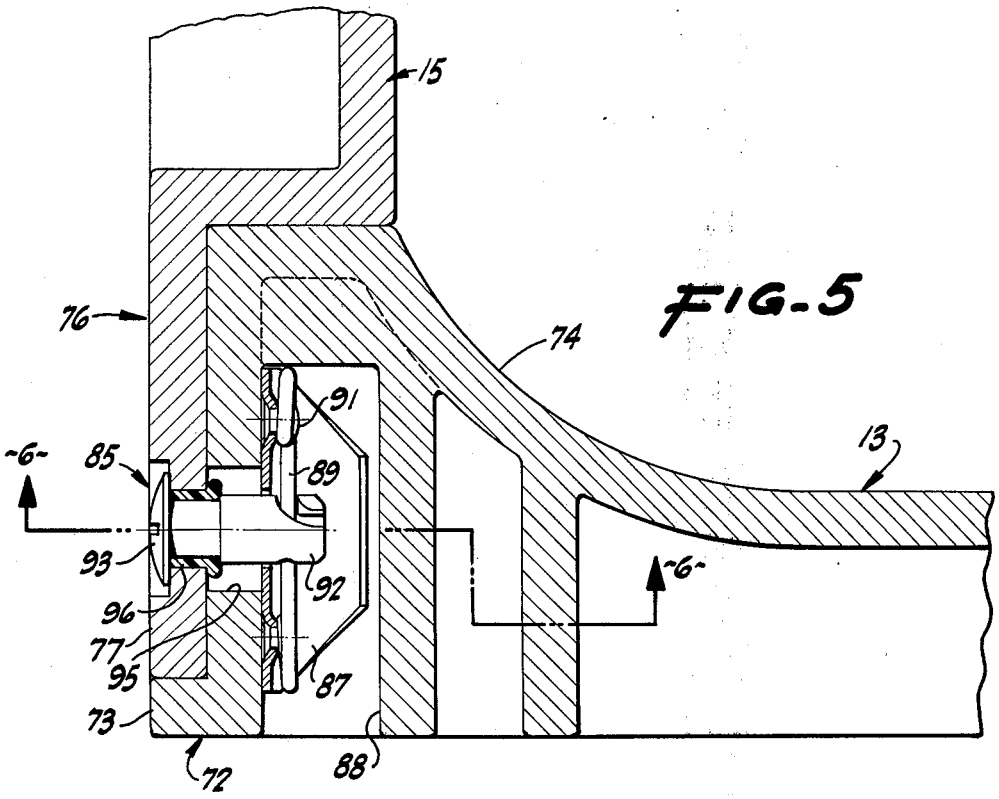
FIG. 5 is a partial sectional view taken along the line 5—5 of FIG. 1.

One lateral side of each panel is provided with a vertically extending side tenon 72 which is molded on the outside with a narrow ridge 73 and on the inside with a surface 74. The lower planar end of this side tenon is spaced above the top end of partial tenon 51 to form a horizontal slot into which the base corner can be inserted and captured. A vertically extending side mortise is 76 formed in the opposite side of each panel. The thickness of the outer wall 77 of this mortise is commensurate with the depth of ridge 73 so that when the side tenon 72 of an adjacent panel interfits with the mortise a smooth continuation of the outer surface of the panel is formed, as best illustrated in FIG. 5.

The outer surfaces of the panels are formed with a matrix of reinforcing ribs 78, 79 to provide a strong and lightweight construction. Pairs of recesses 81, 82 are molded from the outer surfaces of the panels into the partial and intermediate tenons for purposes of reducing bulk and weight of these members.

Figure 6:
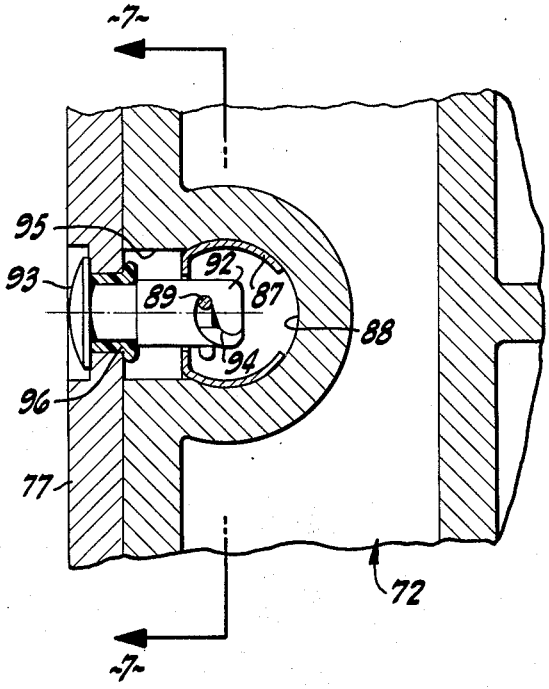
FIG. 6 is a cross-sectional view taken along the line 6—6 of FIG. 5.
Figure 7:
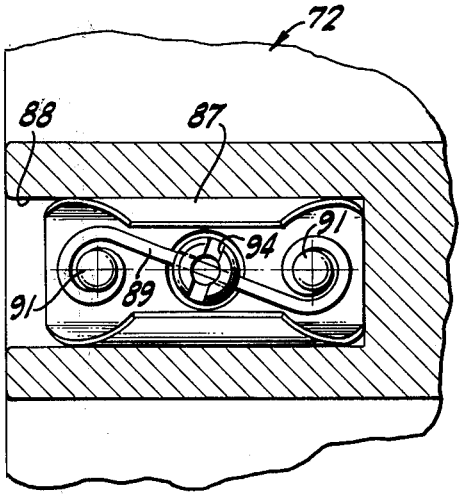
FIG. 7 is a cross-sectional view taken along the line 7—7 of FIG. 6.

Fastener means is provided for securing together the interfitting side tenons and mortises of the panels. The fastener means at each corner includes a plurality, shown as three, of vertically spaced quick-release fastener assemblies 83–85. The fastener assembly 85 illustrated in FIGS. 5–7 for securing the side mortise of panel 15 to the side tenon of panel 13 is typical of the assemblies and includes a receptacle body 87 of semicylindrical configuration which is seated within a cylindrical cavity 88 molded through the outer side of panel 13. An S-shaped spring detent 89 is secured at its opposite ends by suitable rivets 91 to opposite ends of the receptacle body. The detent spans across an opening 95 formed through the wall of the side tenon into cavity 88. A locking stud 92 with a slotted head 93 is provided with a socket end having a right-hand helical slot 94. The stud is rotatably mounted in an annular grommet 96 which in turn is mounted through a recessed opening formed in outer wall 77 of the side mortise so as to prevent withdrawal of the stud. Fastener 85 is engaged by turning the stud clockwise through a short arc with a suitable tool so that the slot 94 engages spring detent 89 and draws the mortise wall against the tenon. The fastener is quickly released by merely turning the stud counter-clockwise until the spring disengages from the slot.

In the use and operation of the invention container 10 is assembled by inserting the tenons 50–51 and 72, ledges 65–69 and locking ribs 58, 59, 64 on each of the panels into the corresponding mortises, sockets and slots along the sides of the base. The three studs of the fastener assemblies 83–85 on each of the panels are turned so as to lock with the spring detents and securely hold the side panels together. The base is thereby captured between the panels without the requirements of separate fateners. The perimeter of the base is supported on the upper surfaces of the corner and intermediate tenons as well as the upper and lower ledges. The overhang portion of the panels as well as the lower ends of the side tenons are disposed over the outer margin of the base for holding it in place. The engagement of the locking ribs with the short slots formed about the base serves to key the base in position.

The assembled container can now be packed with fresh produce and shipped to destination. The slots in the base provide air circulation during transport. The non-absorbent plastics material construction avoids contamination of the produce. At destination the container can be quickly knocked down by releasing each of the fasteners and separating the panels from the base, with the fasteners remaining in the panels. The panels and base can now be stacked in a relatively small space for return shipment or storage, and thereafter quickly reassembled for further use.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A produce container comprising the combination of a rectangular planar base, means forming corner mortises on the corners of the base, four planar side panels mounted in upstanding relationship about the periphery of the base to define an upwardly open enclosure, means forming partial tenons projecting from opposite lower corners of each panel, with each partial tenon cooperating with a partial tenon of an adjacent panel to define a corner tenon which interengages with a respective corner mortise of the base, ledge means along the inner lower margin of each panel for supporting the side margins of the base, means forming a vertically elongate side mortise along one edge of each panel, means forming a vertically elongate side tenon along the opposite edge of each panel with the side tenon of each panel interfitting into the side mortise of an adjacent panel at a respective corner of the container, and fastener means for securing together the interfitting side tenons and mortises whereby the base is captured between the side panels.

2. A container as in claim 1 in which the partial tenons on each panel are formed with beveled faces disposed at an angle of substantially 45° with the panel and extending inwardly of the enclosure, with the beveled faces of the cooperating partial tenons abutting together to form a corner tenon.

3. A container as in claim 2 in which each partial tenon is formed in the shape of a prism having top and bottom triangular ends with the top ends of the cooperating partial tenons supporting a respective corner of the base.

4. A container as in claim 3 in which a portion of each panel projects over a portion of the top ends of the partial tenons to define horizontal slots therewith, and with the corners of the base being captured within the respective horizontal slots.

5. A container as in claim 3 which includes locking rib means formed on the top ends of the partial tenons, and means forming vertical slots in the corners of the base with the ribs seated in the respective vertical slots.

6. A container as in claim 1 which includes means forming an intermediate tenon on the lower side margin of each panel between the partial tenons, and means forming an intermediate mortise on each side of the base in cooperating engagement with the respective intermediate tenon of the adjacent panel, and each intermediate tenon being formed with a top surface for supporting the respective side of the base.

7. A container as in claim 6 in which a portion of each panel projects over the top end of the intermediate tenon to define a horizontal slot, with a portion of each side of the base being seated in the slot, the ledge means comprises a plurality of horizontally elongate ledges projecting inwardly from the lower margin of each panel, and the sides of the base are formed with horizontally elongate sockets, with each ledge being seated in engagement with a respective socket for vertically supporting the base.

8. A container as in claim 1 in which each partial tenon is formed with a top planar end, each side tenon is formed with a lower planer end, and each corner of the base is captured between the top end of cooperating partial tenons and the lower end of a side tenon on the adjacent panel.

9. A container as in claim 1 in which the corner tenons project below the plane of the base and define support feet for the container, and means forming openings between the corner tenons on at least one side of the base for insertion of lifting tines of a forklift type truck.

10. A container as in claim 1 which includes means forming a plurality of slots through the base for circulation of air into and from the container.

11. A container as in claim 1 in which the fastener means comprises means forming fastener bodies disposed in receptacles in the side tenons of each panel, and coupler means mounted in the side mortises of each panel for locking engagement with respective fastener bodies.

12. A container as in claim 1 in which the base and side panels are moded from a plastics material.

13. A knock-down produce container comprising the combination of a rectangular planar base molded of a plastics material, means forming rectangular corner mortises on the bottom of the corners of the base, means forming rectangular intermediate mortises on the bottom of the sides of the base, means forming vertical slots through the base at the corner and intermediate mortises, means forming a plurality of horizontally elongate sockets along the side edges of the base, four rectangular planar side panels mounted on respective sides of the base, means forming prism-shaped partial tenons on opposite lower corners of each panel with each partial tenon having a beveled face extending inwardly toward the base at an angle of substantially 45° with the respective panel whereby the partial tenons of adjacent panels cooperate together to form a corner tenon which interfits with a respective corner mortise of the base, means forming intermediate tenons projecting from the lower margins of the panels between the partial tenons with each intermediate tenon engaging into a respective intermediate mortise of the base, means forming a plurality of horizontally elongate ledges along the lower margins of each panel with each ledge seating in a respective socket of the base, means forming locking ribs on the the upper surfaces of the partial and intermediate tenons with each locking rib engaging with a respective slot formed in the sides of the base, means forming a vertically elongate side mortise along one edge of each panel, means forming a vertically elongate side tenon along the opposite edge of each panel with the side tenon of each panel interfitting into the side mortise of an adjacent panel, and quick-release fastener means for securing together the interfitting side tenons and mortises.

* * * * *